United States Patent [19]

Dezelan

[11] 4,341,149

[45] Jul. 27, 1982

[54] SELECTIVELY ACTUATABLE FLUID CONTROL SYSTEM FOR A WORK ELEMENT

[75] Inventor: Joseph E. Dezelan, Western Springs, Ill.

[73] Assignee: Caterpillar Tractor Co., Peoria, Ill.

[21] Appl. No.: 95,191

[22] PCT Filed: Aug. 30, 1979

[86] PCT No.: PCT/US79/00667

§ 371 Date: Aug. 30, 1979

§ 102(e) Date: Aug. 30, 1979

[87] PCT Pub. No.: WO81/00598

PCT Pub. Date: Mar. 5, 1981

[51] Int. Cl.[3] ..... F15B 11/16

[52] U.S. Cl. ..... 91/526; 60/413; 60/416; 91/420; 91/445; 91/531

[58] Field of Search ..... 60/413, 433, 471, 416; 91/420, 463, 445, 531; 137/102

[56] References Cited

U.S. PATENT DOCUMENTS

| | | | |
|---|---|---|---|
| 2,506,008 | 5/1950 | Arps | 60/471 |
| 2,765,622 | 10/1956 | Hill | 60/433 |
| 3,857,404 | 12/1974 | Johnson | 137/102 |
| 3,872,670 | 3/1975 | Deselan | 60/413 |
| 3,908,687 | 9/1975 | Wood | 91/420 |
| 3,974,742 | 8/1976 | Johnson | 91/420 |
| 4,033,236 | 7/1977 | Johnson | 91/463 |
| 4,192,338 | 3/1980 | Gerulis | 91/420 |

*Primary Examiner*—Abraham Hershkovitz

*Attorney, Agent, or Firm*—Sixbey, Bradford & Leedom

[57] ABSTRACT

A fluid control system for selectively holding a work implement, such as a blade in a motor grader or the like, in a fixed position in a first operation mode, and for selectively providing a shock absorbing system (70,72) for the implement in a second operating mode. In the fixed position mode, lock valves (36,38,68) are operative to provide positive locking for an implement actuator (24,26), while in the shock absorbing mode, long-stem lock valves (82,84) are operable to maintain one check valve (102) of a dual valve structure (96,98) unseated at all times. Each unseated check valve (102) provides a connection of one end of an implement actuator (24,26) to vent to insure that the shock absorbing system (70,72) maintains a full shock absorbing capacity.

6 Claims, 1 Drawing Figure

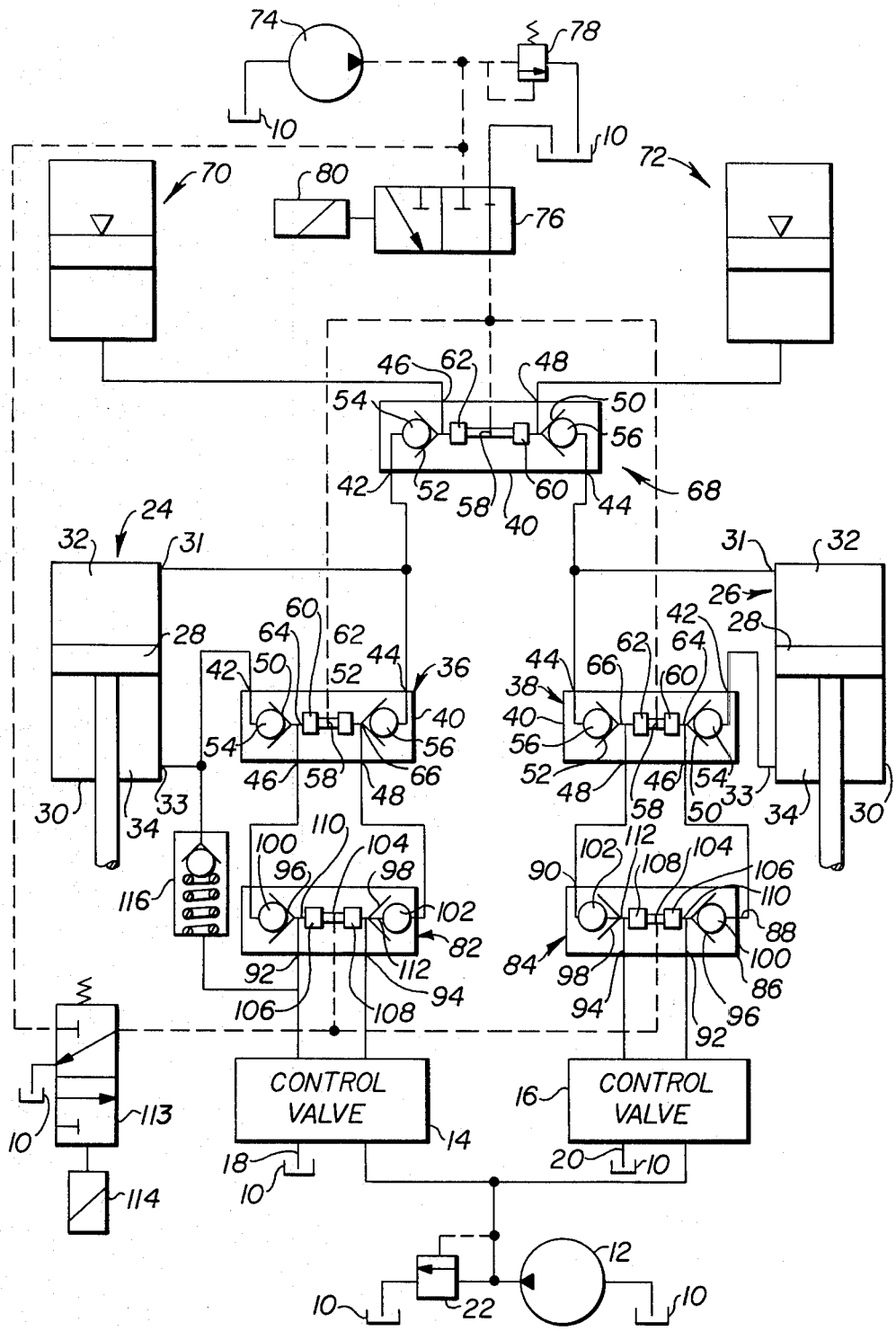
CONTROL VALVE
CONTROL VALVE

SELECTIVELY ACTUATABLE FLUID CONTROL SYSTEM FOR A WORK ELEMENT

DESCRIPTION

1. Technical Field

This invention relates to a fluid control system for a work implement of a motor grader and the like, the system being selectively operable to establish the work implement in a fixed position for a fine grading operating mode, and/or for insuring a full implement shock absorbing capacity in the system for a rough grading operating mode.

2. Background Art

Earth working and moving machines often have operating implements, such as grader blades, which are controlled by fluid control circuits selectively activated at the option of an operator of the machine. In motor graders for example, the work implement consists of a blade which is used in basically two different operating modes, one for rough grading and the other for fine grading. In the fine grading mode, the blade or implement is maintained in a fixed position, whereas in the rough grading mode, the system preferably includes means to absorb the shocks which result from the implement or blade encountering hard immovable objects such as rocks which might be embedded in the soil.

The grader blade for earth working or grading machines is normally maintained in the fixed position fine grading mode for relatively long periods of time to produce a level road surface. To accomplish and maintain accurate blade positioning, the control system for the grader blade normally includes lock valves in the fluid circuit for the blade lift jacks which control blade elevation. Such lock valves are normally positioned between a control valve and the corresponding lift jack, and serve to block fluid flow from the jack when the control valve is in a neutral or working position. With fluid flow from the lift jacks blocked, the blade is held in a fixed position and is unable to drift.

During rough grading operations, a motor grader can travel at relatively high speeds, and the implement or blade can frequently encounter immovable objects such as rocks etc. Thus the lock valves which were used in the fixed position operating mode must be deactivated or the blade will be prevented from moving at impact and damage to both the blade or related components may result. When the lock valves are deactivated, it is desirable to activate a shock absorbing system to absorb large forces experienced by the grader blade from contact with immovable objects.

The combination of a lock valve-shock absorbing system for earth working machines is shown and described in detail in U.S. Pat. No. 3,872,670 issued Mar. 25, 1975, to Joseph E. Dezelan et al. This patent discloses lock valves of the type referred to which include a pair of ball type check valves provided with pilot pressure actuated pistons for selectively moving the check valves away from a seated position against a spring bias. Another somewhat similar lock valve structure is disclosed in U.S. Pat. No. 3,857,404 issued Dec. 31, 1974 to Howard L. Johnson.

As shown in the Johnson patent, a lock valve may include a one-way choke means which cooperates with a metering means to control fluid flow from the hydraulic blade lift jacks. This combination effectively controls blade movement but does create a back pressure in the fluid line from the lift jack to the lock valve. Also, it has been found that in systems which include lock valves in combination with shock absorbing accumulators, it is possible, when the lock valve closes, to trap high pressure in the head ends of the blade lift jack cylinders. Since these head ends are connected to a shock absorbing accumulator when the grader blade is locked, for rough grading, this trapped high pressure greatly reduces the effective volume of oil in the accumulator and thus correspondingly decreases the ability of the accumulator to effectively cushion shock.

DISCLOSURE OF THE INVENTION

The present invention is directed to an improved fluid control system for controlling the work implement of an earth moving machine which provides effective shock absorbtion when the work implement is in a locked position. Such fluid control system will normally constitute a hydraulic system and will be described as such, but air or gas under pressure might provide the motive fluid in some embodiments of this invention.

In one aspect of the present invention, a hydraulic system is provided for selectively controlling a work implement during either a shock absorbing mode or a fixed position mode of operation. This system includes a hydraulic circuit having a lock valve means operable to provide positive locking for the work implement in the fixed position mode by blocking fluid flow from both the head and rod ends of a lift jack cylinder. In the shock absorbing mode, the head end of the lift jack cylinder is connected to an accumulator and the head end is also vented to a supply tank by a long stem lock valve. This is normally done through a restrictive orifice in a control valve to release to the tank all residual pressure on the end of the lift jack cylinder which is in communication with the accumulator.

The present invention further provides a novel hydraulic system for controlling the blade of a motor grader wherein the known combination of lock valves and accumulators are employed to lock the grader blade during a fine grading operation while the accumulators are brought into operation to cushion blade induced shock during a rough grading operation. To permit full use of the accumulator oil volume at the accumulator pre-charge setting, a longstem lock valve for each blade lift jack cylinder is added to the lock valve-accumulator combination. The longstem lock valves are similar in construction to conventional lock valves with the exception that a long piston is included which causes one of two ball check valves to always remain open. During a rough grading operation when the accumulator cushioning action is employed, the open check valve in each longstem lock valve vents the head end of the associated blade lift jack cylinder to a supply tank, thus compensating for residual pressure developed in the head end of such cylinder during a blade lift operation. The accumulator connected to the head end of such cylinder is now permitted to operate with the accumulator oil volume at the full pre-charge setting to provide effective blade cushioning.

Additional objects, advantages and features of the invention will be more readily apparent from the following detailed description of a preferred embodiment of the invention when taken together with the accompanying drawings.

BRIEF DESCRIPTION OF THE DRAWINGS

The single FIGURE of the drawings is a schematic diagram of a hydraulic control system which is an embodiment of the present invention.

BEST MODE FOR CARRYING OUT THE INVENTION

Many of the details of the hydraulic control system of the present invention are disclosed in the aforementioned U.S. Pat. Nos. 3,857,404 and 3,872,670, and the disclosures thereof are incorporated herein by reference. The present system will be described with emphasis being primarily directed to the structural features and operation which provide an enhanced accumulator cushioning action during the rough grading operation of a motor grader.

Referring now to the drawing, a fluid supply tank 10 contains fluid which is drawn from the tank by means of a pump 12 to charge the hydraulic control system. The supply tank has been labelled with the single reference numeral 10 although the tank is shown schematically at several different positions in the drawing. In actual use, a single supply tank is normally employed.

The output of the pump 12 is connected to control valves 14 and 16 which receive pressurized fluid from the pump and selectively provide fluid to either raise or lower a motor grader blade or working implement. Each of these control valves is a conventional control valve of a type known to the prior art which may be selectively activated to direct fluid to or from either end of a double acting hydraulic jack. Fluid exhausted from the control valve 14 is returned to the tank 10 by a line 18, while fluid exhausted from the control valve 16 is returned to the tank by a line 20. A relief valve 22 is connected between the output of the pump 12 and the tank 10 and operates to relieve excessive pressure in the hydraulic system.

The blade or working implement of a motor grader is controlled by a pair of conventional lift jacks 24 and 26. Each jack constitutes a double acting hydraulic jack having a piston 28 which divides the interior of a lift jack cylinder 30 into a head end 32 and a rod end 34. Fluid ports 31 and 33 at the head and rod ends respectively of the lift jack 24 are connected to a lock valve 36 while similar fluid ports at the head and rod ends of the lift jack 26 are connected to a lock valve 38.

The structural details of the lock valves 36 and 38 are shown in U.S. Pat. No. 3,872,670, but basically each lock valve includes a cylindrical housing 40 defining a valve bore having an upper pair of laterally spaced ports 42 and 44 and a lower pair of laterally spaced ports 46 and 48 communicating therewith. A pair of identical spring biased ball check valve assemblies 50 and 52 are mounted at opposite ends of the valve bore and include normally seated ball valves 54 and 56. The check valve assembly 50 is interposed between the ports 42 and 46 and normally blocks fluid flow between these ports while the check valve assembly 52 is interposed between the ports 44 and 48 to normally block fluid flow therebetween.

The ball valves 54 and 56 may be unseated to permit fluid to flow between the valve ports 42 and 46 and the valve ports 44 and 48 respectively. This is accomplished by applying fluid pressure to a chamber 58 between two pistons 60 and 62. These pistons are connected to plungers 64 and 66 respectively which are moved axially of the valve bore as the pistons move apart to unseat the ball valves 54 and 56.

As previously noted, the lock valve 36 is connected to the head and rod ends of the lift jack 24 while the lock valve 38 is connected to the head and rod ends of the lift jack 26. In each instance, the port 42 of the respective valve is connected to the rod end 34 of the lift jack while the port 44 is connected to the head end 32 of the lift jack. This permits the normally seated ball valves 54 and 56 to simultaneously block fluid discharge from the head and rod ends of the lift jacks 24 and 26 at the lock valves 36 and 38.

The head ends 32 of the lift jacks 24 and 26 may be selectively connected by a lock valve 68 to shock absorbing accumulators 70 and 72. These accumulators are of a well known type, such as the gas charged fluid accumulators conventionally used for shock absorbtion in hydraulic systems.

The lock valve 68 is identical in construction to the lock valves 36 and 38 and consequently corresponding structural components are identified by the same reference numeral. The ports 42 and 44 of the lock valve 68 are connected to the head ends of the lift jacks 24 and 26 respectively while the ports 46 and 48 are connected to the accumulators 70 and 72 respectively.

The lock valves 36, 38 and 68 are pilot operated valves, and as previously indicated, fluid pressure in the chamber 58 of these valves operates to unseat the ball valves 54 and 56. To accomplish this lock valve operation, a pilot pump 74 provides fluid under pressure from the tank 10 to a two position solenoid operated valve 76. The output of the pilot pump is also connected to a relief valve 78 which vents the pilot system to the tank 10 if excessive pressure is developed in the pilot system. This pilot system is shown in broken lines in the drawing to distinguish it from main hydraulic system shown in solid lines. The pilot system alternatively may be provided with pressurized fluid from the main pump 12, in which case the pilot pump 74 and relief valve 78 would be eliminated.

The solenoid operated valve 76 is shown in a first position in the drawing wherein the flow of pressurized pilot fluid from the pilot pump 74 is blocked, and thus the ball valves 54 and 56 of the lock valves 36, 38 and 68 are seated as shown. However, when a solenoid 80 for the solenoid operated valve is actuated to move the valve to its second position, pressurized pilot fluid is provided through the solenoid operated valve to the chambers 58 of the lock valves 36, 38 and 68.

To this point, the hydraulic system described would be quite similar to known systems if the ports 46 and 48 of the lock valves 36 and 38 were directly connected to the control valves 14 and 16. However, in accordance with the present invention, longstem lock valves 82 and 84 are interposed between the control valves 14 and 16 and the lock valves 36 and 38. These longstem lock valves are similar in construction and operation to the lock valves 36, 38 and 68 with the exception that in the normal position of the valve when pressurized pilot fluid is absent, one of the ball valves will always remain open. This is insured by forming the piston plungers for operating the ball valves in a manner which will maintain one ball valve unseated when the remaining ball valve seats as illustrated in the drawing. Longstem lock valves of this type are well known as illustrated in German Pat. No. DT25 35 751 of Feb. 17, 1977, U.S. Pat. No. 2,506,008 issued May 2, 1950, to B. J. Arps, and U.S. Pat. No. 2,765,622 issued Oct. 9, 1956 to D. R. Hill et al.

Considering now in detail the longstem lock valves 82 and 84, each valve includes a cylindrical housing 86 which encloses a central valve bore. An upper pair of spaced valve ports 88 and 90 and a lower pair of spaced valve ports 92 and 94 communicate with the valve bore. The lower valve ports of the longstem lock valve 84 are connected to the control valve 16 while the upper ports 88 and 90 are connected to the lower ports 46 and 48 respectively of the lock valve 38. Similarly, the lower valve ports of the longstem lock valve 82 are connected to the control valve 14 while the upper ports 88 and 90 are connected to the lower ports 46 and 48 respectively of the lock valve 36.

A pair of spring biased ball check valve assemblies 96 and 98 are mounted at opposite ends of the valve bore. The ball check valve assembly 96 includes a normally closed ball valve 100 while the ball check valve assembly 98 includes a normally open ball valve 102. Thus the ball check valve assembly 100 normally blocks fluid flow between the ports 88 and 92 while fluid flow is permitted between the ports 90 and 94.

To further unseat the ball valves 102 and to unseat the ball valves 100 to permit fluid to flow between the ports 88 and 92 pilot fluid under pressure is applied to a chamber 104 in each of the longstem lock valves 82 and 84. This pilot fluid moves pistons 106 and 108 apart forcing piston connected plungers 110 and 112 axially outward along the valve bore to unseat the ball valves 100 and 102. The length of the plungers 110 and 112 is such that only one of the ball valves 100 and 102 can be seated when pilot fluid pressure is removed from the chambers 104.

Pilot fluid under pressure from the pilot pump 74 is selectively provided to the chambers 104 under the control of a two position solenoid operated valve 113. When the valve 113 is in the first position shown in the drawing, pilot fluid is not permitted to flow from the pilot pump 74 to the longstem lock valve chambers 104, and the ball valves 100 and 102 of the longstem lock valves 82 and 84 are in the position illustrated. Operation of a solenoid 114 to move the solenoid operated valve 113 to the second position connects the pilot pump 74 to the pilot chambers 104.

A spring biased relief valve 116 is connected between the rod end of the lift jack cylinder for the lift jack 34 and the discharge line to the control valve 14. This relief valve protects the system from damage when operating the centershift with the jack lift cylinders locked.

INDUSTRIAL APPLICABILITY

In the operation of the hydraulic system on a motor grader by means of the control valves 14 and 16 to raise a blade or working implement, it has been found that high pressure can be trapped in the head end 32 of the lift jacks 24 and 26. In a conventional system using lock valves and accumulators, if the head ends of the lift jacks are connected to the accumulators, this increased head end pressure opposes the precharge setting of the accumulator thereby greatly reducing the effective volume of the accumulator and its ability to act as a shock absorber. However, in the present system if it is desireable to accomplish a rough grading operation after the blade is positioned, the solenoid 80 is activated to cause the solenoid valve 76 to permit pilot fluid from the pump 74 to reach the chambers 58 of the lock valves 36, 38 and 68. At the same time, the solenoid 114 is conditioned to cause the solenoid valve 113 to block the flow of pilot fluid to the longstem lock valves 82 and 84, and these valves will be positioned as shown in the drawing.

Under the influence of pilot fluid pressure in the chambers 58, the ball valve assemblies 50 and 52 of the lock valves 36, 38 and 68 open to connect the head ends 32 of the lift jacks 24 and 26 to the respective accumulators 70 and 72.

With the ball valve assemblies 52 of the lock valves 36 and 38 open, the head ends 32 of the lift jacks 24 and 26 are also connected through the open valve assemblies 98 of the longstem lock valves 82 and 84 and the control valves 14 and 16 to the tank 10. Thus all residual pressure on the ends of the lift jacks in communication with the accumulator is released to the tank, and full use of the accumulator oil volume at its precharge setting is provided. The control valves 14 and 16, when in a neutral position, provide a limited bleed path to the tank 10, for the ports of the control valves leading to the tank are not completely closed. This may be observed by referring to FIG. 3 of the aforementioned U.S. Pat. No. 4,033,236 wherein it will be noted that the port 82 of the control valve shown in slightly open.

Since the longstem lock valves are incapable of locking both the head and rod ends of the lift jack cylinders simultaneously, the blade may move ¼ to ½ inches when blade load reversals are encountered. Although this movement cannot be tolerated in a finish grading operation where a high degree of accuracy is required, it poses no problem in rough hard road type grading.

For finish grading, the solenoid 80 moves the solenoid valve 76 to the position shown in the drawing to block pilot fluid flow to the lock valves 36, 38 and 68. The solenoid valve now vents the chambers 58 of these lock valves to the tank 10, and the valve assemblies 50 and 52 close. With the lock valves 36, 38 and 68 closed, both the head and rod ends of the lift jacks 24 and 26 are blocked so that the blade is locked in place for finish grading. At this time, the solenoid 114 is operated to cause the solenoid valve 113 to provide pilot fluid from the pilot pump 74 to the chambers 104 of the lonstem lock valves 82 and 84. This opens the ball valve assemblies 96 and 98 of both longstem lock valves.

To completely understand the operation of the lock valves 36, 38 and 68 and the longstem lock valves 82 and 84, it is important to note the relationship between the valve ports and the ball check valve assemblies thereof. For example, in the lock valves 36, 38 and 68, the valve ports 46 and 48 constitute inlet ports while the ports 42 and 44 constitute outlet ports. With no pilot fluid pressure in the chamber 58, fluid flowing through an inlet port under sufficient pressure will operate to unseat the respective ball valve 54 or 56 and at the same time will act against the associated piston 60 or 62 to force the piston away from the unseated ball valve so as to unseat the remaining ball valve. Thus the control valves 14 and 16 might direct fluid through the inlet ports 48 of the lock valves 36 and 38 and the ball valves 54 would be automatically opened to facilitate the passage of discharge fluid coming in through the outlet ports 42.

The reverse occurs, however, if fluid is introduced under pressure through the outlet ports 42 and 44 with no fluid pressure in the chamber 58. This incoming fluid operates against closed ball valves 54 and 56 and thus only adds to the spring pressure forcing the ball valves closed against the valve seat.

The longstem lock valves 82 and 84 operate in substantially the same manner as the lock valves 36, 38 and 68, with the valve ports 92 and 94 constituting inlet ports while the ports 90 and 96 are outlet ports.

The inlet ports of the lock valve 68 are connected to the accumulators 70 and 72 while the outlet ports are connected to the head ends 32 of the lift jacks 24 and 26. It will therefore be apparent that when fluid is directed through the valve assemblies 52 of the lock valves 36 and 38 to the head ends of the lift jacks, this fluid is prevented from reaching the accumulators 70 and 72 by the closed valve assemblies 50 and 52 of the lock valve 68.

Other aspects, objects and advantages of this invention can be obtained from a study of the drawings, the disclosure and the appended claims.

I claim:

1. A hydraulic system for controlling the work element of an earth working machine comprising hydraulic motor means (24,26) for moving said work element, said hydraulic motor means (24,26) including at least one lift jack (24) connected to move said work element, said lift jack (24) including a lift jack cylinder (30) and a piston (28) mounted for movement within said lift jack cylinder (30) which divides said lift jack cylinder (30) into a head end (32) and a rod end (34), fluid source means (10,12) for providing fluid to said hydraulic motor means (24,26), control means (14,16) connected to said fluid source means (10,12) for alternately directing a flow of fluid into and out of said head and rod ends (32,34) of said lift jack cylinder (30), shock absorbing means (70,72), including fluid accumulator means (70,72), and a lock valve system (36, 38, 68, 82,84) connected between said control means (14,16), said hydraulic motor means (24,26) and said shock absorbing means (70,72), said lock valve system (36,38,68,82,84) including first lock valve means (36,38) connected to said head and rod ends (32,34) of said lift jack cylinder (30), said first lock valve means (36,38) being selectively operable to permit or block fluid flow from said head and rod ends (32,34) of said lift jack cylinder (30) and said accumulator means (70,72), second lock valve means (68) being selectively operable to connect or disconnect said head end (32) of said lift jack cylinder (30) to said accumulator means (70,72), and longstem lock valve means (82,84) connected between said first lock valve means (36,38) and said control means (14,16), said longstem lock valve means (82,84) being operable in combination with said first lock valve means (36,38) to vent residual pressure at the head end (32) of said lift jack cylinder (30) when said head end (32) is connected to said accumulator means (70).

2. The hydraulic system of claim 1 wherein said longstem lock valve means (82, 84) includes at least one longstem lock valve (82) having a valve chamber, first and second valve inlet ports (92, 94) and first and second valve outlet ports (88, 90) communicating with said valve chamber, first and second check valve means (96, 98) interposed respectively between said first and second valve inlet (92, 94) and outlet (88, 90) ports to control fluid flow therebetween, and piston means (106, 108) operative to unseat said first and second check valve means (96, 98), said piston means (106, 108) being formed to normally maintain one of said first and second check valve means (96, 98) unseated to permit fluid flow between one set of said inlet and outlet ports.

3. The hydraulic system of claim 2 wherein said first lock valve means (36,38) includes a first lock valve (36) and said second lock valve means (68) includes a second lock valve (68), said first and second lock valves (36,68) each having valve inlet (46,48) and outlet (42,44) ports, check valve means (50,52) interposed between said inlet (46,48) and outlet (42,44) ports and operable to permit or block fluid flow between said valve outlet (42,44) and inlet (46,48) ports, and piston means (60,62) operative to unseat said check valve means (50,52).

4. A hydraulic system for controlling the work element of an earth working machine comprising:

(a) hydraulic motor means (24,26) for moving said work element, said hydraulic motor means (24,26) including at least one lift jack (24) connected to move said work element, said lift jack (24) including a lift jack cylinder (30) and a piston (28) mounted for movement within said lift jack cylinder which divides said lift jack cylinder into a head end (32) and a rod end (34);

(b) fluid source means (10, 12, 14, 16) for providing fluid to said hydraulic motor means;

(c) shock absorbing means (70,72) including fluid accumulator means (70,72); and (d) a lock valve system including:

(1) first lock valve means (36,38) having a first lock valve (36) connected to said head and rod ends (32,34) of said lift jack cylinder (30), said first lock valve means (36,38) being selectively operable to block fluid flow from said head and rod ends (32,34) of said lift jack cylinder (30), (2) second lock valve means (68) having a second lock valve (68) connected between said head end (32) of said lift jack cylinder (30) and said accumulator means (70,72), said second lock valve means (68) being selectively operable to connect or disconnect said head end (32) of said lift jack cylinder (30) to said accumulator means (70,72), said first and second lock valves (36,68) each having valve inlet (46,48) and outlet (42,44) ports, check valve means (50,52) interposed between said inlet (46,48) and outlet (42,44) ports to permit or block fluid flow between said valve outlet (42,44) and inlet (46,48) ports, and piston means (60,62) operative to unseat said check valve means (50,52), (3) longstem lock valve means (82,84) connected between said fluid source means (10, 12, 14, 16) and said first lock valve means (36,38), said longstem lock valve means (82,84) being operable in combination with said first lock valve means (36, 38) to vent residual pressure at said head end (32) of said lift jack cylinder (30), said longstem lock valve means (82,84) having at least one longstem lock valve (82) with a valve chamber, first and second valve inlet ports (92,94) and first and second valve outlet ports (88,90) communicating with said valve chamber, first and second check valve means (96,98) interposed respectively between said first and second valve inlet (92,94) and outlet (88,90) ports to control fluid flow therebetween, and piston means (106, 108) operative to unseat said first and second check valve means (96,98), said piston means (106, 108) being formed to normally maintain one of said first and second check valve means (96,98) unseated to permit fluid flow between one set of inlet and outlet ports, and (4) first control means (76) for simultaneously causing the piston means (60,62) of said first and second lock valves (36,68) to unseat the check valve means (50,52) therein and second control means (112) for causing the piston means (106,108) of said longstem lock valve (82) to unseat the first and second check valve means (96,98) therein, said first lock valve (36) operating with the check valve means (50,52) thereof unseated to connect the head end (32) of said lift jack cylinder (30) to said longstem lock valve (82) and said second lock valve (68) operating with the check valve means (50,52) thereof unseated to connect the head end (32) of said lift jack cylinder (30) to said accumulator means (70).

5. The hydraulic system of claim 4 wherein said first lock valve (36) operates with the check valve means (50, 52) thereof seated to block fluid flow from the head and rod ends (32, 34) of said lift jack cylinder (30).

6. The hydraulic system of claim 1, wherein said hydraulic motor means includes first and second lift jacks (24,26) connected to move said work element, each such lift jack including a lift jack cylinder (30) and a piston (28) mounted for movement within said lift jack cylinder, said piston (28) dividing the lift jack cylinder (30) into a head end (32) and a rod end (34), said control means (14,16) includes first (14) and second (16) control valves, said first lock valve means (36,38) includes a first lock valve (36) connected between said head and rod ends (32,34) of said first lift jack cylinder (30) and a third lock valve (38) connected between said head and rod ends (32,34) of said second lift jack cylinder (30), said second lock valve means (68) includes a second lock valve (68) connected between said head ends (32) of said first and second lift jack cylinders (30) of said accumulator means (70,72), and said longstem lock valve means (82,84) includes a first longstem lock valve (82) connected between said first control valve (14) and said first lock valve (36) and a second longstem lock valve (84) connected between said second control valve (16) and said third lock valve (38).

* * * * *